United States Patent [19]

Pedersen

[11] Patent Number: 4,548,364

[45] Date of Patent: Oct. 22, 1985

[54] WINDING MACHINE WITH EXCHANGEABLE CASSETTE FOR A WIRE MAGAZINE

[75] Inventor: Jan B. Pedersen, Hvalso, Denmark

[73] Assignee: Tortrix A/S, Denmark

[21] Appl. No.: 538,368

[22] PCT Filed: Sep. 18, 1989

[86] PCT No.: PCT/DK80/00058

§ 371 Date: May 13, 1981

§ 102(e) Date: May 13, 1981

[87] PCT Pub. No.: WO81/00841

PCT Pub. Date: Apr. 2, 1981

Related U.S. Application Data

[63] Continuation of Ser. No. 268,995, May 13, 1981, abandoned.

[30] Foreign Application Priority Data

Sep. 24, 1979 [DK] Denmark ..... 3969/79

[51] Int. Cl.[4] ..... H01F 41/08; B65H 81/02

[52] U.S. Cl. ..... 242/4 B; 57/17; 156/425; 242/7.21

[58] Field of Search ..... 242/4 R, 4 B, 4 BE, 242/7.21, 7.22, 7.23; 57/3, 13, 14, 15, 16, 17, 18; 156/397, 425, 433, 422

[56] References Cited

U.S. PATENT DOCUMENTS

| | | | |
|---|---|---|---|
| 2,974,890 | 3/1951 | Davis | 242/4 B |
| 3,400,894 | 9/1968 | McIntosh et al. | 242/4 B |
| 3,669,365 | 6/1972 | Loturco | 242/4 B |
| 3,848,819 | 11/1974 | Fukushima | 242/4 B |
| 3,982,705 | 9/1976 | Peck et al. | 242/4 B |
| 4,079,895 | 3/1978 | deFenffe | 242/4 B |

FOREIGN PATENT DOCUMENTS

| | | | |
|---|---|---|---|
| 684472 | 12/1952 | United Kingdom | 242/4 B |
| 770545 | 3/1957 | United Kingdom | 242/4 B |
| 789434 | 1/1958 | United Kingdom | 242/4 B |

OTHER PUBLICATIONS

Jan B. Pedersen, International Publication WO79/00763, Pub. Oct. 4, 1979.

*Primary Examiner*—Billy S. Taylor
*Attorney, Agent, or Firm*—Robert J. Koch

[57] ABSTRACT

A winding machine for the winding of endless members such as toroidal cores (31) is designed with an exchangeable cassette (12) for a wire magazine (13), whereby the winding machine may be rapidly and readily readjusted from one winding operation to another requiring a different form or wire magazine. Guide means for rotational movement of the wire magazine are accommodated in the cassette, whereas all driving means (14–19) for rotating the magazine (13) are positioned in the machine frame (11). The cassette (12) is composed of two parts (12*a*, 12*b*) which are journalled with each other and may be opened and closed by operation of a common operator member (25) in the machine frame (11) which cause prismatic supports (37*a*, 37*b*) on which the magazine parts (12*a*, 27*b*) are supported to turn in reverse directions around a common axis (23). The wire magazine (13) which is composed of two annular halves separated by a bottom slit and a filling slit, is guided by bogie guide assemblies and associated pressure chambers, to which compressed-air supplied for controlling the tension of the wire (33) drawn out through the bottom slit of the wire magazine.

17 Claims, 11 Drawing Figures

WINDING MACHINE WITH EXCHANGEABLE CASSETTE FOR A WIRE MAGAZINE

This application is a continuation of application Ser. No. 268,995, filed 5/13/81, now abandoned.

TECHNICAL FIELD

The present invention relates to a winding machine for the winding of elongate members or cores, preferably endless cores, comprising an exchangeable and openable, substantially annular wire magazine having a slit for drawing out winding wire on its side facing the axis of revolution, and a machine frame provided with guide means and driving means for rotational movement of the wire magazine around said member or core, whereby winding wire is supplied to the wire magazine in the same operation as winding wire is drawn out through said slit.

BACKGROUND ART

For the winding of elongate members or cores for use in wire wound resistors, coils and transformers in electrical or electronic equipment, winding machines are known which with respect to their function can be divided in a number of principal types, such as disclosed in the specification of applicants' international patent application PCT/DK79/00008, international publication No. WO79/00763.

For the winding of closed members, winding machines of the so-called single-ring type are normally used in case of smaller wire dimensions, and winding machines of the so-called double-ring type in case of greater wire dimensions. Machines of the single-ring type are superior with respect to the winding speed, whereas the requirements to accurate positioning of the winding wire on the core which arises, for example, in case of controllable resistors or transformers are fulfilled to a greater extent by winding machines of the double-ring type.

From U.S. Pat. No. 2,974,890 a winding machine of the single-ring type is known operating in accordance with an immediate or direct winding procedure, which means that winding wire is supplied to a wire magazine in the machine in the same operation in which wire is drawn out from the rotating wire magazine for winding of the core. In this prior art machine, the wire magazine comprises two rings of circular cross-section which are kept in mutual engagement with a common axis of revolution by three pulley-shaped rollers, one of which is pressed against the magazine with an adjustable contact pressure so as to maintain the wire tension during the drawing of the wire between the rings within desirable limits. However, this prior art machine has not found any application in practice, mainly due to the following disadvantages.

In order to enable a selective wire-drawing, the wire diameter must be great relative to the cross-sectional diameter of the two magazine rings, whereby, in addition to a limited applicability with respect to wire dimensions, inferior residual hole conditions in the winding of endless members will result.

The winding object must be centrally positioned with respect to the wire magazine, since an excentrical location will result in an acute drawing angle, whereby the wire tension will be mainly tangential relative to the magazine with the resulting risk of slipping of the wire in the drawing slit between the two rings. Also this requirement results in inferior residual hole conditions in the winding of endless members.

Moreover, since the prior art winding machine described does not comprise any holding means for the wire supply left in the wire magazine between the two rings after cutting of the winding wire, so that the supply of wire into the magazine must be continued right to the end of the winding operation, a return coiling of the wire surplus in the magazine must be performed after each wire operation, if a great overconsumption of winding wire should be avoided.

In addition, it is common to the prior art winding machines that they can only be used together with a specific type of wire magazine, since accurate matching is required between the wire magazine and the magazine holder of the winding machine with guide means for the wire magazine, so that it is not possible with one and the same winding machine to comply with the different requirements as to the design of the wire magazine which are made in different winding operations in dependence, inter alia, of the wire dimension and the demands to storage capacity of the wire magazine and winding accuracy. In practice, this has resulted in a limited applicability of a specific winding machine, so that it has often been necessary to change to a different machine. For example, it has not been possible in the prior art to use the same machine both for wire winding and so-called bandaging, i.e. winding of a wire-wound core with insulation tape.

Moreover, the prior art machines do not fulfil the requirements with respect to safety of labour, since the wire magazine and the guide, and driving means therefor must normally be freely accessible in order to enable reasonably easy operation of the machine.

From U.S. Pat. No. 3,669,365 a winding machine of the single-ring type is known, in which the wire magazine has the form of a shuttle which must be filled with wire in a separate operation preceding the winding operation, since the filling of wire into the magazine requires an opposite direction of rotation of the wire magazine relative to the winding operation. In this prior art machine, the shuttle holder which is firmly connected with the machine frame and is provided with guide means is made openable to receive different shuttle types. The arrangement of guide means in this prior art machine comprises guide rollers both on the external side of the shuttle and on the internal side facing the axis of revolution, and already for this reason this machine is not suitable for use with wire magazines of the above-mentioned kind in which wire is supplied to the magazine in the same operation as the winding operation in that wire is drawn out from the magazine through a bottom slit.

DISCLOSURE OF THE INVENTION

Taking as a starting point a winding machine of the single-ring type for immediate or direct winding, said machine being of the kind described in the foregoing, it is the object of the invention to provide the possibility of using one and the same winding machine having driving means for the wire magazine and holding and driving means for the winding object together with different kinds of wire magazines, so that for each individual winding operation, a wire magazine having a bottom slit may be used, the design of which is optimized for the winding operation in question with respect to wire dimension, storage capacity of the wire magazine, winding accuracy, etc. In particular, it is also aimed to use one and the same winding machine for wire winding as well as bandaging, for which purposes completely different magazine designs and matching magazine guide means are required.

According to the invention, such an exchangeability is realized in a simple manner in that the wire magazine is arranged in a cassette which accommodates said guide means and is detachably coupled with a part of the machine frame by securing means and coupling means for operating the wire magazine being provided in said cassette and being designed to engage corresponding means on said part of the machine frame, whereas all driving means for rotational movement of the wire magazine and operator means for opening and closing the wire magazine are arranged in said part of the machine frame.

A possibility for automation opening of the wire magazine for positioning and removal of the winding object can be realized in a simple manner by designing the wire magazine so that said cassette comprises two parts which are pivotally journalled with each other and are designed to engage each of two prismatic support members when being coupled to the machine, said support members being connected through coupling means with a common operator means for turning said prismatic support members in reverse directions around a common axis for opening and closing the cassette, each of said two cassette parts comprising guide means designed to retain the magazine for opening the magazine simultaneously with the opening of the cassette. Since the two cassette parts are turned through equal angles, the positioning and removal of the winding object may always take place in one and the same level relative to the machine frame by means, for example, of a horizontal movement, whereby the winding machine is prepared in a simple manner for further automization of the operating functions, for example through the use of robot operation.

By designing the cassette so that the two cassette parts have side walls covering said guide means as well as said wire magazine on the major part of the peripheral length thereof, a substantially closed construction may be obtained, in which in addition to the operator means of the machine only the working position of the winding object will be accessible from the outside. As a result hereof, a considerably improved safety of labour is obtained.

A further possibility of automization may be obtained in that said machine part is supported on slideways so as to be linearly displaceable together with the cassette in a direction perpendicular to the rotational axis of the wire magazine and in a plane comprising said axis. Thereby, the cassette with the wire magazine may always be adjusted to a working position, in which the winding object is localized in a given position independent of the diameter of the magazine.

In addition, the winding machine may in a manner known per se be adjustable with respect to the height of the winding position.

A safe coupling of the cassette and the wire magazine to the driving means of the machine independent of the size of the wire magazine may be obtained in that said drive means for rotational movement of the wire magazine comprises a drive roller engaging the wire magazine through a number of intermediate rollers each of which can be adjusted to a predetermined contact pressure against the magazine and be disengaged therefrom by an operator means, the coupling means for said cassette comprising selector means for said contact pressure. Said intermediate rollers may be formed of a suitable soft material, since they are disengaged from the magazine in the rest condition.

A preferred embodiment of the winding machine is characterized in that said cassette comprises control means associated with said guide means for controlling the tension of the winding wire drawn out from the wire magazine. For a given cassette with associated wire magazine, the wire tension may then be adjusted to the actual wire dimension and winding operation.

Said control means may suitably comprise pressure chambers associated with said guide means for adjusting the contact pressure of said guide means against the wire magazine, the means on said part of the machine frame engaging said coupling means on the cassette comprising supply nipples for supplying a pressure fluid to said pressure chamber.

The invention also relates to a cassette for a wire magazine for use together with the winding machine, which cassette is characterized by accommodating guide means for rotational movement of the wire magazine, as well as securing means and coupling means designed for exchangeable coupling of the cassette to the winding machine by engagement with corresponding means on a part of the machine frame.

In a preferred embodiment of such a cassette for use together with a wire magazine comprising two annular parts forming together the storage space of the wire magazine for winding wire and separated by a bottom slit through which winding wire can be drawn out from the magazine, the guide means of the cassette comprise support means and permanent magnets keeping the two parts of the wire magazine separated and pressed against said support means.

Since as mentioned in the foregoing, control means for controlling the tension of the winding wire drawn out from the wire magazine are preferably associated with the guide means, said preferred embodiment may further be characterized in that said support means are arranged together with said permanent magnets on bracket members which are displaceably arranged in the cassette, said control means comprising pressure chambers to which a pressure fluid may be supplied through said coupling means for controlling the wire tension by displacement of said bogie consoles. By cooperation of the forces with which the magazine is influenced by the magnets and the pressure chambers, a very accurate control of the wire tension is thereby obtained.

In this embodiment, the cassette may suitably comprise braking means against which the two parts of the wire magazine are pressed by said permanent magnets upon removal of pressure fluid from said pressure chambers. Thereby, the magazine will always be braked when the machine is in the rest condition, or the cassette is removed from the machine. Since the openable wire magazine having two annular parts is composed of four elements, it is thereby secured that these elements are correctly positioned relative to each other both during operation and in the rest condition.

BRIEF DESCRIPTION OF DRAWINGS

In the following, the invention will be explained in further detail with reference to the schematical drawings, in which.

DETAILED DESCRIPTION

In the winding machine according to the invention shown in FIG. 1, there is coupled to a part of the machine frame forming a winding head 11, an exchangeable cassette 12, in which a wire magazine 13 is supported by guide means allowing the magazine 13 to rotate freely, the detailed construction of said cassette being explained in the following.

Figure 1:
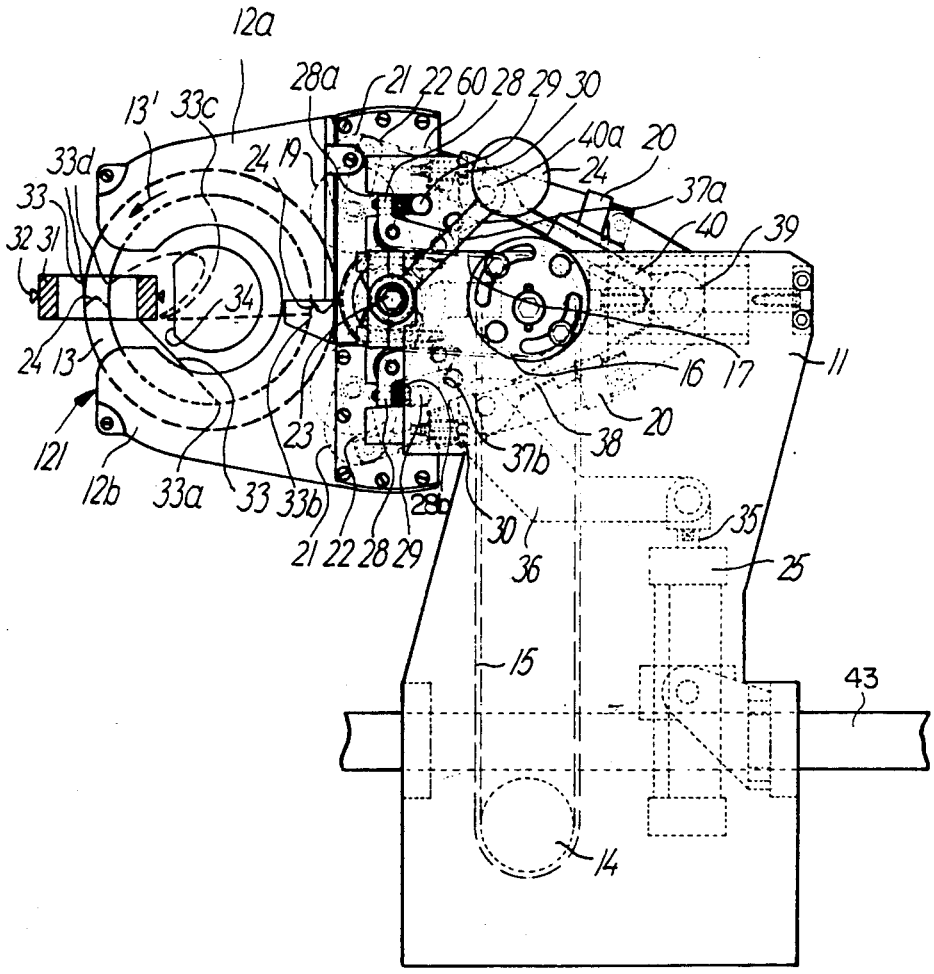
FIG. 1 shows an embodiment of a winding machine with an exchangeable cassette according to the invention, in a side view.
Figure 2:
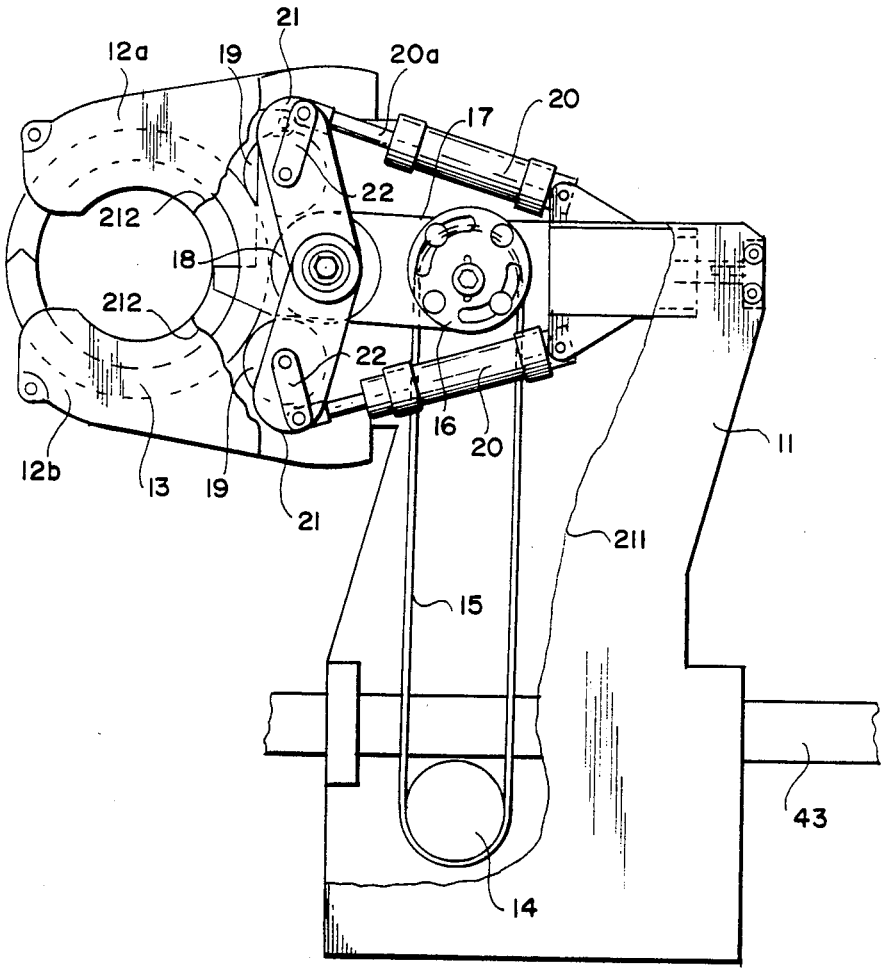
FIGS. 2, 3 and 4 are schematical extracts of FIG. 1 for specifically illustrating the driving means for the wire magazine, the coupling means for the exchangeable cassette, and the operator means for opening of the cassette and the wire magazine, respectively.

In FIG. 2, the driving means for the wire magazine have been specifically illustrated by removal of other components of the machine and the cassette in the rather complex illustration in FIG. 1. Side walls of the machine frame part 11 and cassette parts 12*a* and 12*b* have been partly removed between lines 211 and 212.

As a driving means for rotating the circular magazine 13 in the cassette 12, a motor 14 is provided in the machine frame, which motor as more clearly shown in FIG. 2 drives a drive roller 18 through a belt 15, an intermediate pulley 16 and a belt 17, said drive roller engaging rubber-covered intermediate rollers 19 which engages the wire magazine 13 when the cassette 12 is coupled to the machine. The intermediate rollers 19 are journalled in respective arms 21 which are pivotally journalled with respect to a main shaft 23 of the machine, on which also the drive roller 18 is journalled, said arms being connected through arms 22 with piston rods 20' of the two respective compressed-air cylinders 20 serving to bring the intermediate rollers 19 into engagement with the magazine 13. From the compressed-air cylinders 20 with piston rods 20*a*, the arms 21 are influenced through the arms 22 on each side of the intermediate rollers 19 to bring the intermediate rollers 19 into engagement with the magazine with a constant, controllable contact pressure. This pressure is adjusted according to the magazine size, so as not to exceed the contact pressure between the magazine 13 and the magazine guide means of the cassette 12 in that air supply lines to the compressed air cylinders pass through an adjustable pressure reduction valve, not shown, which is built into the cassette 12. The operation of the compressed air cylinders 20 and associated members 20*a*, 21 and 22 acting on the intermediate rollers will be explained in more detail in the following.

Figure 5:
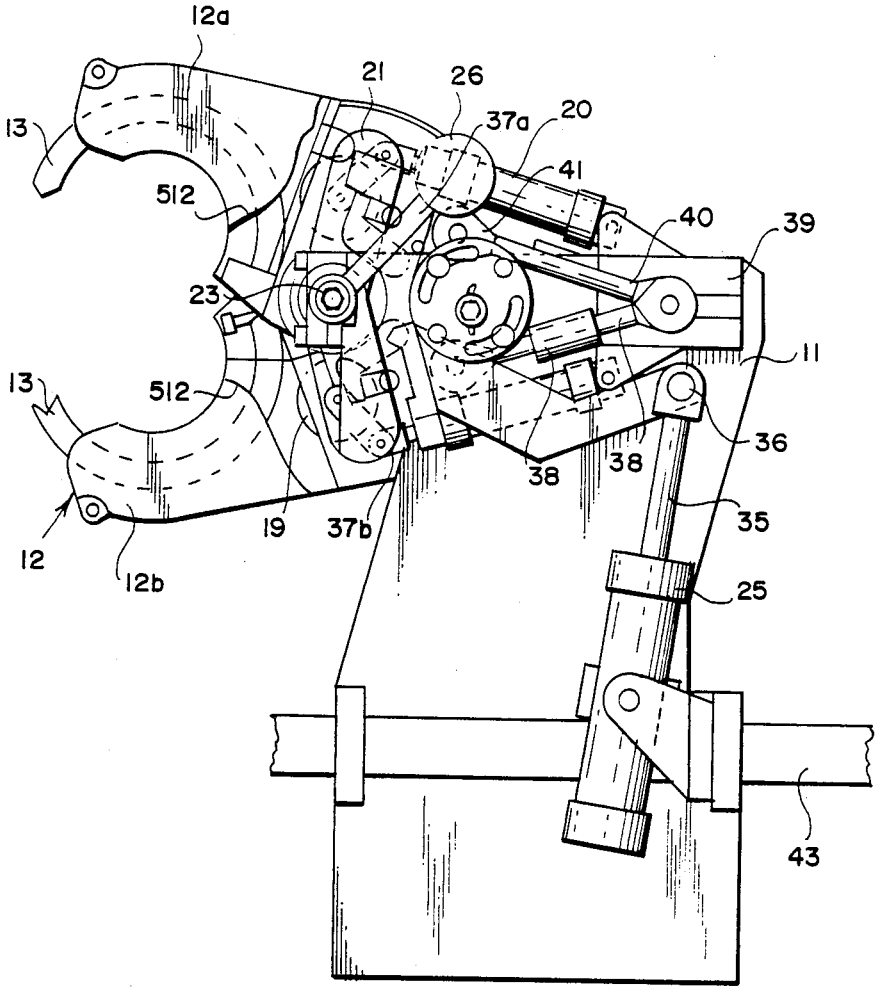
FIG. 5 shows the winding machine in FIG. 1 with opened cassette and wire magazine.
Figure 6:
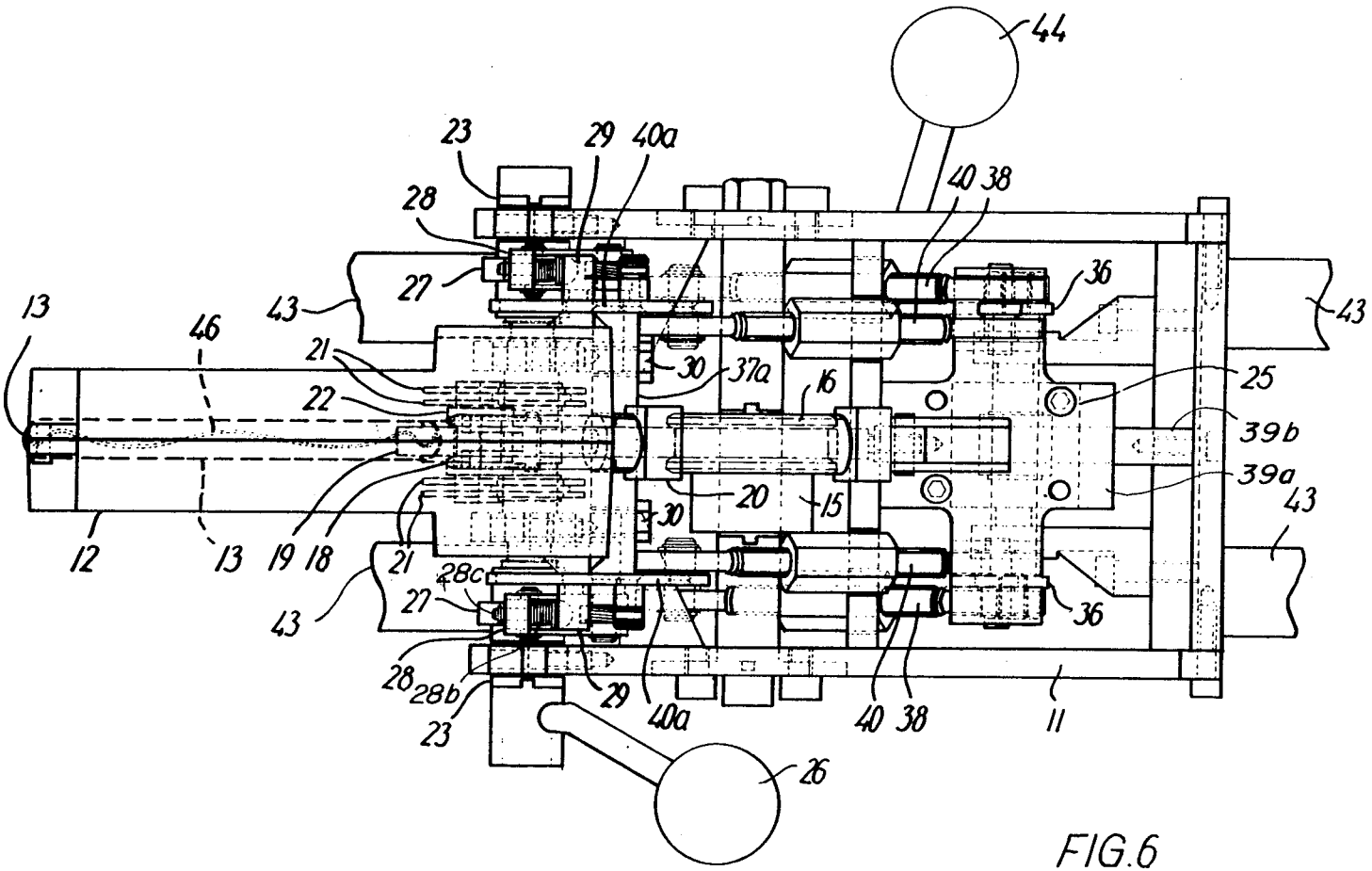
FIG. 6 shows the winding machine in FIG. 1, viewed from above.
Figure 11:
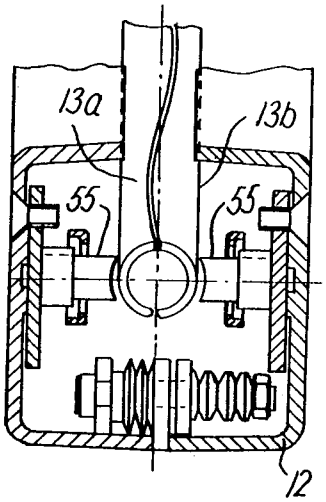
Figure 10:
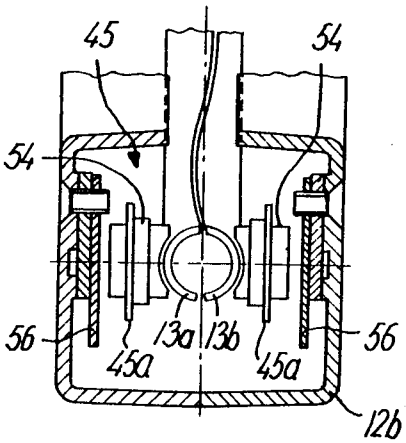
Figure 9:
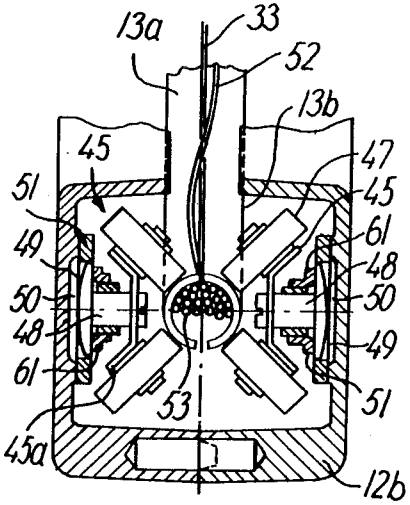

As shown in FIGS. 5 and 6, the wire magazine 13 comprises in the embodiment shown four semi-circular partial elements, which for opening the magazine may be separated at joining faces 24 (see FIG. 1). On the side of the magazine 13 facing the axis of revolution, a bottom slit 52 separates the four partial elements into annular halves 13*a* and 13*b*, as shown in FIGS. 9 to 11, which form together the storage space of the magazine for winding wire.

The illustrated wire magazine 13 is described in applicants' international patent application PCT/DK80/00057, International Publication No. W081/00840, and will, therefore, not be described in further detail.

Figure 7:
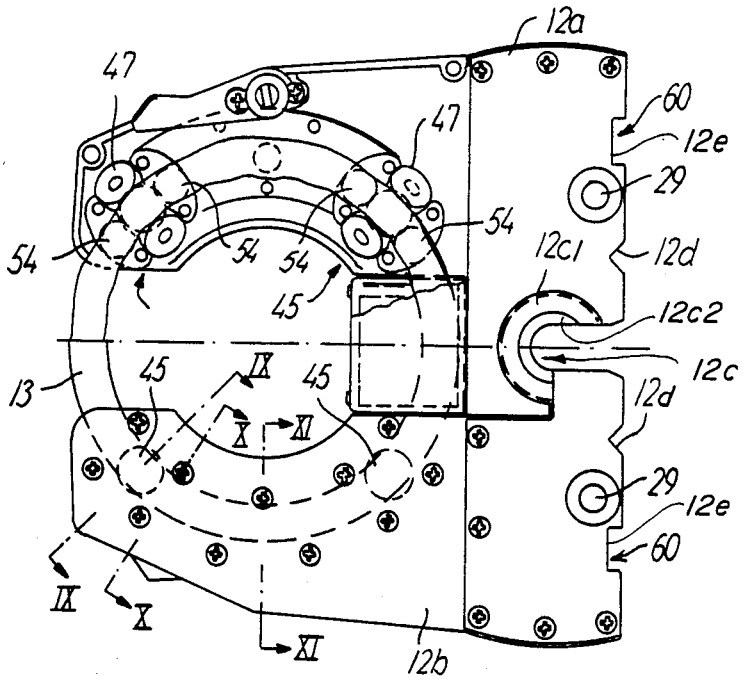
FIG. 7 shows the exchangeable cassette removed from the machine frame and with exposed guide means.
Figure 8:
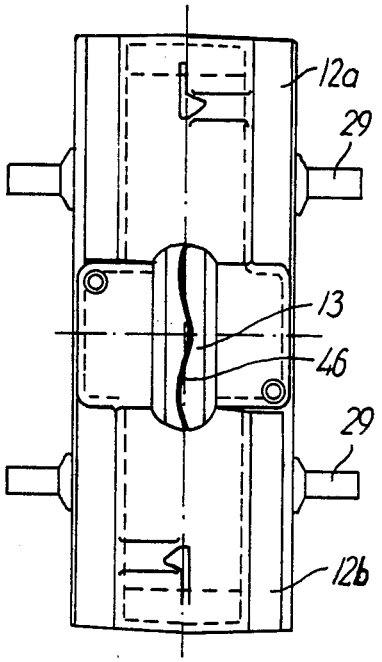
FIG. 8 is a front view of the cassette in FIG. 7, and FIGS. 9 to 11 are sectional views of the cassette in FIG. 7 after the lines IX—IX, X—X and XI—XI, respectively.

As shown in FIGS. 7 and 8, the cassette 12 is divided into two parts 12*a* and 12*b*, which are pivotally journalled with each other at a bearing 12*c* comprising bearing parts 12*c*1 and 12*c*2 connected with the respective cassette parts 12*a* and 12*b*, one bearing part 12*c*1 surrounding the other bearing part 12*c*2 through an angle exceeding 180°, so that the pivotally connected cassette parts 12*a* and 12*b* cannot be removed from one another. The bearing 12*c* which is journalled on a main shaft 23 when the cassette is coupled to the machine, so that the cassette parts 12*a* and 12*b* by operation of operator means on the machine may be opened as shown in FIG. 5 and, thereby, additionally open the magazine 13 at the joining faces 24 for positioning or removal of a member, such as a torroidal core, which is going to be wound or has already been wound. By journalling the two cassette parts 12*a* and 12*b* to each other, it is obtained that the cassette, also when removed from the machine part 11, forms a unit and not two separate parts.

Figure 3:
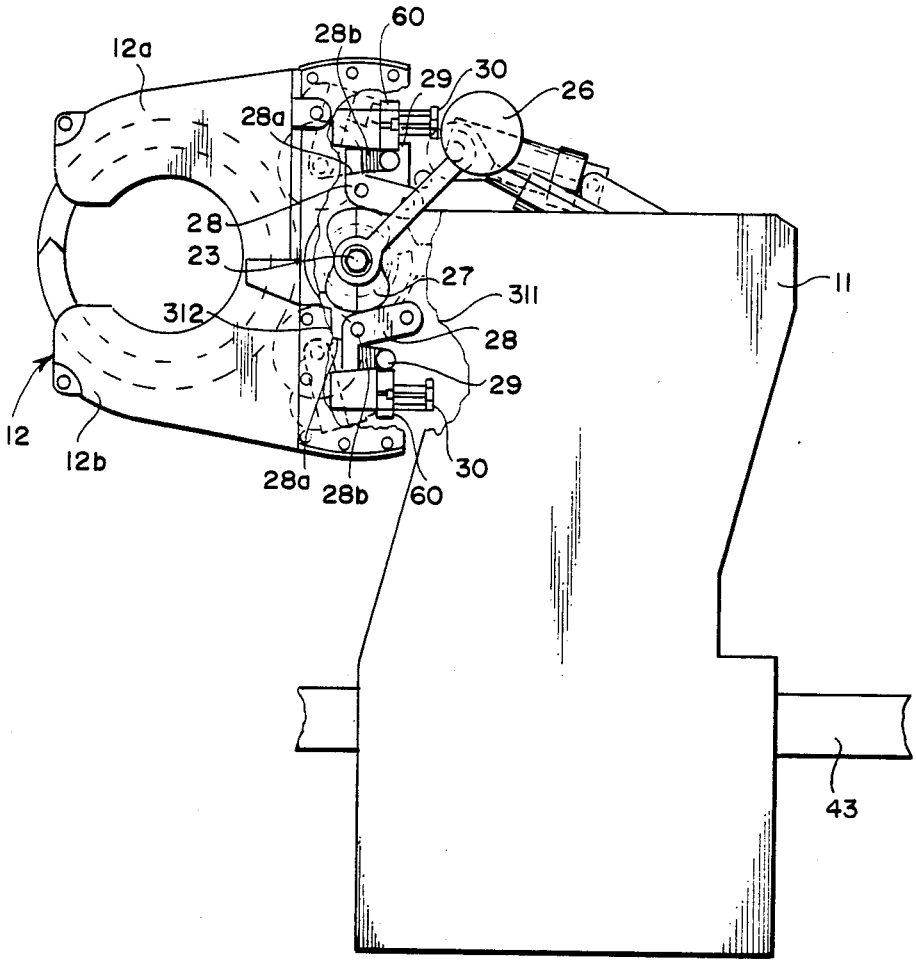

In FIG. 3, the coupling means for connecting the exchangeable cassette with the machine have been specifically illustrated by removal of other components of the machine and cassette side walls of machine frame part 11 and cassette parts 12*a* and 12*b* have been partly removed between lines 311 and 312.

As interlocking means for coupling to the machine frame, the cassette is provided with pins 29 projecting from both sides of each cassette part. As more clearly shown in FIG. 3, the pins 29 are introduced into cutouts 28*a* in the machine and retained therein by releasable locking means comprising pressure arms 28, which are influenced by a cam disc 27 secured on shaft 23 to press the pins 29 into the cutouts against the action of bias springs 28*b* arranged on pins 28*c*, secured in pressure arms 28 as shown in FIG. 6. The cam disc 27 may be turned by means of an operator handle 26 connected with the shaft 23, whereby the pressure arms 28 as a result of the spring bias follow the contour of the cam disc 27, and the pins 29 of the cassette 12 are released for removal of the cassette.

Moreover, as a coupling means each cassette part 12*a* and 12*b* comprises a coupling member 60 for a pressure fluid which upon coupling to the machine part 11 is connected with a supply nipple 30 connected with a source, not shown, for pressure fluid. With each of the coupling members 60 is connected the above mentioned pressure reduction valve for preselection of the contact pressure of the intermediate rollers 19 against the wire magazine 13, on one hand, and, on the other hand, a pressure medium line for supplying pressure medium to the control means in each of the cassette parts 12*a* and 12*b*, explained in the following.

Figure 4:
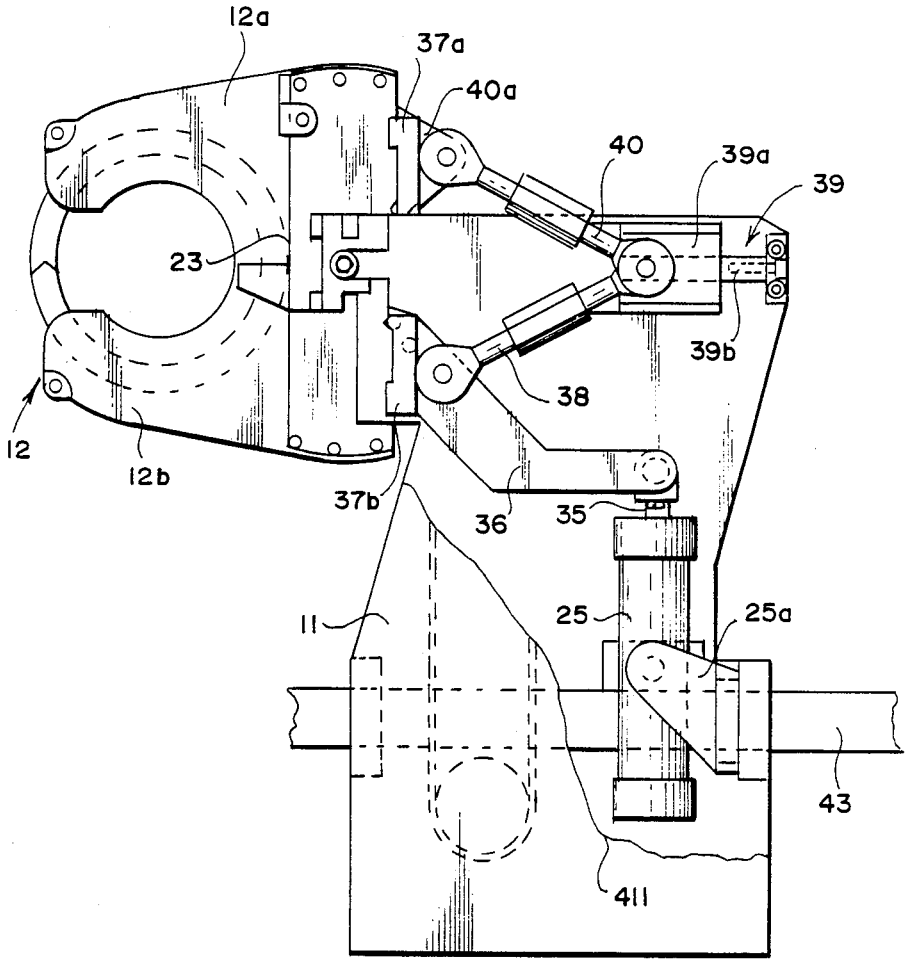

In FIG. 4, the operator means for opening of the cassette and the wire magazine have been specifically illustrated by removal of other components of the machine and the cassette. The side wall of machine frame part 11 has been partly removed above line 411.

Upon coupling of the cassette 12 to the machine part 11 by pins 29 on the cassette being pressed into the cut-outs 28*a* by the pressure arms 28, cut-outs 12*d* and 12e on each of the two cassette parts 12a and 12b, more clearly shown in FIG. 7, are caused to engage each of two pairs of prismatic supports 37a and 37b, as more clearly shown in FIG. 4, which are journalled in the machine part 11 and coupled together in such a manner that they can perform reverse angular movements around the main shaft 23 for opening and closing the cassette 12 and the wire magazine arranged therein.

More specifically, the prismatic supports 37b controlling the lower cassette part 12b are connected with one end of arms 36 which are pivotally connected in their opposite end with a piston rod 35 in a double-acting compressed-air cylinder 25 which is pivotally mounted in a bearing console 25a on the machine frame. The operation of compressed air cylinder 25 and associated members 35 to 40a to open and close cassette parts 12 and 12b will be explained in more detail in the following.

FIG. 5 shows the components of the driving means, coupling means and operation means specifically illustrated in FIGS. 2, 3 and 4, respectively, which would occupy changed positions after opening of the cassette and the wire magazine. The side wall of machine frame part 11 has been fully removed, and the side walls of cassette parts 12a and 12b have been removed to the right of line 512.

As illustrated in FIGS. 4 and 5, an outwards movement of the piston rod 35 results in a rearwards and upwards displacement of the joint of the piston rod with the arms 36, whereby the cassette part 12b will be turned counter-clockwise around the shaft 23 by the accompanying displacement of the prismatic supports 37b. By the movement of the arms 36, the joints between the connecting rods 38 and the connecting rods 40 is caused to be linearly displaced in the linear guideways 39 accompanied by oppositely directed angular movements of connecting rods 38 and 40 of equal magnitude. By the movement of the consoles 40a and the resulting movement of the prismatic support 37a caused by the movement of the connecting rods 40, the upper cassette part 12a is caused to perform an angular clockwise movement of the same magnitude as the counter-clockwise angular movement of the cassette part 12b. By this opening movement, in which the opening angle is limited by the displacement of the connecting rods 38 and 40 in the linear guideways 39, it is made possible that horizontal positioning and removal of the toroidal core 31 which is going to be wound or has been wound, may always take place in the same level relative to the winding machine, whereby the machine is made particularly suitable for automatic operation.

In connection therewith, the winding head 11 of the machine is supported on horizontal slideways 43, as shown in FIG. 6, on which the winding head 11 may be secured in any position by means of a locking arm 44 which may operate suitable clamping means in a manner not further illustrated. As a result of this possibility for horizontal displacement of the entire winding head 11, the cassette 12 with the wire magazine 13 may be adjusted horizontally independent of its magnitude in such a position that the winding object, i.e. the toroidal core 31, is always positioned at the same place relative to the winding machine.

The winding object, which is shown in the drawings in the form of a toroidal core 31, is positioned in this way relative to the wire magazine 13 in guide means 32, which are only shown schematically and may be of a design known per se, said guide means being constructed to cause rotational movement of the toroidal core 31 around its own axis simultaneously with the winding by means of the wire magazine 13, which rotates in the direction shown by an arrow 13'.

During rotation of the wire magazine 13, winding wire 33 is filled into the magazine 13 from a wire supply, not shown, and the toroidal core 31 is wound in one and the same operation, since the wire 33 is supplied to the magazine through a filling slit 46 on the external side of the magazine 13, such as shown in FIG. 6, whereas wire is drawn out from the magazine through the above-mentioned bottom slit 52 on the side facing the axis of revolution, such as shown in FIGS. 9 to 11.

In FIG. 1, the course of the winding wire between the bottom slit 52 and the toroidal core 31 is shown in four different angular positions 33a, 33b, 33c and 33d. In the three latter positions, the wire is guided between guide plates 34.

During rotation, the wire magazine 13 is guided in the cassette parts 12a and 12b by guide means, which in the embodiment shown comprise two bogie like guide assemblies 45 in each of the cassette parts 12a and 12b.

As shown in FIG. 9, each of these bogie like guide assemblies comprises four guide rollers 47 for supporting the magazine 13, said guide rollers being positioned around the cross-section of the magazine with a mutual angular displacement of 90° and being constituted by outer rings in ball bearings, the inner rings of which are secured to bracket members 45a. In the rest position, i.e. without rotation or with the cassette 12 and the magazine 13 removed from the machine, the bracket members 45a which are displaceably journalled in seats 51 are caused by permanent magnets secured to the bracket members 45a to be attracted to engagement towards soft iron abutments 56, such as shown in FIG. 10, said permanent magnets 54 also causing the annular magazine halves 13a and 13b on each side of the bottom slit 52 to be engaged with the guide rollers 47 and, in this particular position, also to be attracted towards rubber abutments 55, such as shown in FIG. 11, which brake and retain the magazine 13 relative to the cassette 12. In this condition, the magnets 54 function as holding means holding the four part elements of the magazine 13 forming together the two halves 13a and 13b in their positions in the cassette 12.

In the operative condition, the magazine halves 13a and 13b are forced by the magnets 54 to be attracted against the guide rollers 47 with a contact pressure always exceeding the above-mentioned controllable contact pressure, by which the magazine 13 is caused to rotate by the intermediate rollers 19. As a result of the magnets 54 being mounted on the bracket members 45a, the relative separation of the guide rollers 47 and the sides of the magazine halves 13a and 13b in contact with the opposed pair of guide rollers provided on the respective bracket members is always the same, whereby it is secured that the reaction against the contact pressure of the intermediate rollers 19 is always caused by the magnets 54 and not by the passage of the winding wire 33 through the bottom slit 52.

Thereby, an accurate control of the wire tension independent of the controlable contact pressure from the intermediate rollers 19 is made possible, which control in the embodiment shown is carried out in that the bracket members 45a are influenced by pistons 48 which engage rubber diaphragms 49 forming walls in pressure chambers 50, to which a pressure fluid is supplied in the manner mentioned in the foregoing, when the magazine is coupled to the machine, from the coupling members 60 connected to the supply nipples 30 of the winding machine. When pressure fluid is supplied to the pressure chambers 50, the magazine halves 13*a* and 13*b* are released from the braking abutments 55, and the wire tension, i.e. the contact pressure between the winding wire 33 and the sides of the bottom slit 52, is controlled by means of the pressure in the pressure chambers 50.

The winding machine according to the invention with the exchangeable wire magazine cassette operates as follows:

When the cassette 12 is to be coupled to the machine, the cassette pins 29 are introduced in the cut-outs 28*a*, whereafter the cassette 12 is secured relative to the machine by operation of the handle 26 which through the cam disc 27 and the pressure arms 28 keeps the pins 29 in position in the cut-outs 28*a*.

By switching the double-acting compressed air cylinder 25 for outwards movement of the piston rod 35, the magazine 13 is opened at the joining faces 24 through the opening of the cassette parts 12*a* and 12*b*, described in the foregoing. Thereby, the winding object, such as the toroidal core 31 with associated guide means, may be positioned as shown in FIG. 1. Thereafter, the winding wire 33 is guided through the open magazine 13 to contact with the core 31.

After this, the pressure causing the upwards movement of the piston rod 35 is removed from the compressed-air cylinder 25, and the cassette parts 12*a* and 12*b* are manually closed, so that the wire 33 now passes through the magazine 13. When the magazine parts have engaged each other at the joining faces 24, the compressed air cylinder 25 is switched by the application of a reverse pressure, whereby the piston rod 35 is kept inserted in the cylinder 25, and the cassette parts 12*a* and 12*b* are secured relative to each other.

Through the supply nipples 30 and the coupling members 60, a pressure is now built up in the compressed-air cylinders 20 through the above-mentioned pressure reduction valves, and pressure fluid is supplied to the pressure chambers 50 in the bogie like guide assemblies 45. Thereby, the intermediate rollers 19 are caused to engage the magazine 13, and the magazine is released from the braking abutments 55.

When the motor 14 is subsequently started, the magazine 13 is caused to rotate in the direction of the arrow 13', and in one and the same operation winding wire 33 is filled into the magazine 13, and the core 31 is wound by drawing out the wire from the magazine 13. In the range between the angular positions 33*a* and 33*b*, a wire length is drawn out from the magazine 13 corresponding to the length of a single winding of the core. Between the angular positions 33*b* and 33*a*, the loop formed by the wire drawn out from the magazine is controlled by means of the guide plates 34. Thus, when a single winding has been wound on the core 31, the magazine 13 has turned through its own circumferential length, i.e. one revolution, plus the length of a single core winding between the angular positions 33*a* and 33*b*, so that for each winding wound on the core 31, a netto wire length or a wire surplus is supplied to the magazine corresponding to the circumferential length of the magazine.

When a sufficient wire supply for the actual winding has been built up in the magazine 13 by this operation, the wire 33 is cut in a manner not shown, and the winding is continued without changing the direction or speed of rotation of the magazine 13.

When a predetermined number of windings on the core 31 has been wound, a possible remaining wire supply in the magazine may be wound on a mandrel which is introduced into the winding field so that all the wire is emptied from the magazine.

After the winding operation, the motor 14 is stopped at horizontal positioning of the joining faces 24 of the magazine 13, the air pressure is removed from the pressure chambers 50 of the bogie like guide assemblies 45 and from the compressed-air cylinders 20, whereby the wire magazine 13 is braked, and the intermediate rollers 19 are disengaged from the magazine, and by subsequent switching of the compressed air cylinder 25, the magazine 13 may be opened and the wound core 31 may be removed.

After being closed again, the cassette 12 with the wire magazine 13 may be removed from the magazine by operation of the handle 26, and another cassette with a different wire magazine which may have a different diameter and/or a different cross-section for the accommodation of winding wire may be coupled to the machine.

Such a different cassette may accommodate, for example, a wire magazine of the double-ring type having a separate wire advancing ring positioned on the side facing the axis of revolution of the magazine ring serving to accommodate the wire supply. Since the driven member in such a magazine is the wire advancing ring, this member must be designed so as to engage the driving means of the winding machine when the cassette is coupled to the machine.

As another possibility, a change may be made to a bandaging cassette having a magazine specially designed for accommodating and delivering insulation tape for bandaging of a core with a completed winding.

I claim:

1. A winding machine for the winding of elongate core members, particularly endless cores, comprising:

core suspension means for suspending a core member to be wound;

an openable, annular two-part magazine for a supply of winding material, said magazine having a slit for drawing out winding material for winding on a core member;

a magazine holder comprising two holder parts, guide means in each holder part for suspending said magazine for rotation around its own axis of revolution in a circular path circumscribing the cross-section of a core member suspended in said core suspension means, and means for connecting the holder parts pivotally with each other with respect to a pivot axis parallel to said axis of revolution;

a machine frame comprising magazine holder mounting means for supporting said magazine holder and drive means for effecting rotation of said magazine in said magazine holder;

said magazine holder being formed as a cassette for exchangeable coupling with said machine frame, said two holder parts forming cassette parts each of which is provided with machine frame interlocking and engaging means;

said magazine holder mounting means comprising cassette receiving means for receiving said interlocking means on each cassette part, releasable locking means associated with said cassette receiving means to secure each cassette part to the machine frame, operator means connected with said locking means operable from the outside of said machine to release said locking means from said cassette receiving means to allow detachment of said cassette, and cassette opening actuator means engageable with said engaging means on each cassette part to effect pivotal movement of the cassette parts with respect to each other.

2. A winding machine as claimed in claim 1, wherein said cassette opening actuator comprises two prismatic supporting members and a common actuator device connected with said prismatic supporting members to turn said members in reverse directions around a common axis, said machine frame engaging means on each cassette part being formed to receive said prismatic supporting members in interlocking engagement so as to be pivoted in reverse directions around said pivot axis by the turning movement of said supporting members, the magazine guide means in said cassette parts being designed to retain respective parts of the magazine to open the magazine concurrently with the pivotal movement of the cassette parts.

3. A winding machine as claimed in claim 1, wherein said drive means in the machine frame comprise a drive roller engaging the magazine through intermediate rollers, supporting means for said intermediate rollers being displaceably arranged in the machine frame, and an actuator device with associated control means being connected with said supporting means to adjust the contact pressure between said intermediate rollers and said magazine, adjustable selector means for said contact pressure being provided in said cassette, said cassette and said cassette receiving means on the machine frame being provided with interconnectable coupling means for connecting said selector means with the control means associated with said actuator device.

4. A winding machine as claimed in claim 1, for use together with a magazine composed of two annular parts, each formed in two semi-circular pieces, said parts being separated on the internal side facing said axis of revolution by said slit for drawing out wire, and on the opposite external side by a filling slit allowing loading of said winding material into the magazine during the winding operation, wherein the magazine guide means in said cassette parts comprise a number of bogie-like guide assemblies, each comprising supporting members for engaging the semi-circular pieces of said annular parts of the magazine, and permanent magnetic devices to attract said semi-circular pieces of the annular magazine parts to keep them separated and pressed into engagement with said supporting members.

5. A winding machine as claimed in claim 4, comprising a common bracket member for arrangement of the supporting members and permanent magnetic devices in each of said bogie-like guide assemblies acting on the same semi-circular pieces of the same annular part of the magazine and means for suspending said bracket member in the cassette to be transversely displaceable, control means being provided which comprise a pressure chamber acting on said bracket member to adjust the mutual separation of said semi-circular pieces of the annular parts of the magazine, said cassette parts and said machine frame being provided with coupling means for connecting pressure fluid supply means for said pressure chamber to operator means in said machine frame.

6. A winding machine as claimed in claim 5, wherein said bogie-like guide assemblies comprise braking means to be engaged by said semi-circular pieces of the annular parts of the magazine by means of said permanent magnetic devices in response to deactivation of said pressure chambers.

7. A winding machine as claimed in claim 1, wherein said cassette parts have side walls covering said magazine guide means as well as said magazine on the major part of the peripheral length thereof.

8. A winding machine as claimed in claim 1, comprising slideways for supporting said machine frame and a cassette detachably secured therewith for linear displacement in a direction normal to the axis of revolution of the magazine and in a plane comprising said axis.

9. A winding machine for the winding of core members, said machine comprising:

a base element, comprising:

a machine frame;

a lockable receptor means mounted on said machine frame;

actuator means mounted on said machine frame for locking said receptor means, said actuator means including means for selective manual operation;

a removable section comprising:

a wire holder in the form of an openable, annular, two-part magazine for supply of winding material, said magazine having a slit for drawing out winding material;

a magazine holder having two pivotally connected parts, each of said pivotally connected parts including guide means for suspending said magazine for rotation around its own axis of revolution;

interlocking means formed on said magazine holder, said interlocking means being formed to mate with said receptor means, to be held to said receptor means when said receptor means is locked, and to be released from said receptor means when said receptor means is unlocked so as to separate said removable section from said base element;

wherein said removable section may be selectively connected to or separated from said base element through said actuator means locking or unlocking said receptor means.

10. A machine as claimed in claim 9 wherein each of said two parts of said magazine is formed in two semi-circular pieces, said magazine parts being separated on an internal side facing said axis of revolution by said slit for drawing-out wire, and on an opposite external side by a filling slit allowing loading of said winding material into the magazine during a winding operation, wherein the magazine holder guide means comprise a number of bogie-like guide assemblies, each comprising supporting members for engaging the semi-circular pieces of said annular parts of the magazine, and permanent magnetic devices to attract said semi-circular pieces of the annular magazine parts to keep them separated and pressed into engagement with said supporting members.

11. A machine as claimed in claim 10, comprising a common bracket member for arrangement of the supporting members and permanent magnetic devices in each of said bogie-like guide assemblies acting on the same semi-circular piece of the same annular part of the magazine and means for suspending said bracket member in the removable section to be transversely displaceable, control means being provided which comprise a pressure chamber acting on said bracket member to adjust the mutual separation of said semi-circular pieces of the annular parts of the magazine, said removable section and said machine base element being provided with coupling means for connecting pressure fluid supply means for said pressure chamber to operator means in machine base element.

12. A magazine holder as claimed in claim 11, wherein said bogie-like guide assemblies comprise braking means to be engaged by said semi-circular pieces of the annular parts of the magazine by means of said permanent magnetic devices in response to deactivation of said pressure chamber.

13. A magazine holder as claimed in claim 9, wherein said removable section has side walls covering said magazine guide means as well as said magazine on the major part of the peripheral length thereof.

14. A winding machine as set forth in claim 9 wherein said receptor means comprises at least one cutout formed in said machine, frame, and said interlocking means comprises at least one pin attached to said removable section and dimensioned to fit within said cutout.

15. A machine as set forth in claim 14 wherein said actuator means comprises at least one pressure arm, and means for moving said pressure arm into and out of said cutout.

16. A machine as set forth in claim 15 wherein said means for moving said pressure arm into and out of said cutout comprises a cam disc attached to an operating handle.

17. A machine as set forth in claim 14 wherein said interlocking means further comprises a cutout on said removable section and said receptor means further comprises a prismatic support coupled to the machine base, said prismatic support being dimensioned to be received in said cutout in said removable section.

* * * * *